US007909117B2

(12) United States Patent
Van Steenwyk et al.

(10) Patent No.: US 7,909,117 B2
(45) Date of Patent: Mar. 22, 2011

(54) DOWNHOLE ADJUSTABLE BENT-ANGLE MECHANISM FOR USE WITH A MOTOR FOR DIRECTIONAL DRILLING

(75) Inventors: Donald H. Van Steenwyk, Paso Robles, CA (US); Dennis J. Buckley, Paso Robles, CA (US); James R. Higginbotham, The Woodlands, TX (US); Mark Chustz, Porter, TX (US); Raymond W. Teys, Pisomo Beach, CA (US); Michael A. Yoshimune, Paso Robles, CA (US)

(73) Assignee: Scientific Drilling International Inc., Houston, TX (US)

( * ) Notice: Subject to any disclaimer, the term of this patent is extended or adjusted under 35 U.S.C. 154(b) by 0 days.

(21) Appl. No.: 12/221,851

(22) Filed: Aug. 6, 2008

(65) Prior Publication Data

US 2010/0032212 A1 Feb. 11, 2010

(51) Int. Cl.
*E21B 7/04* (2006.01)
*E21B 15/04* (2006.01)

(52) U.S. Cl. ..... 175/61; 175/73

(58) Field of Classification Search ..... 175/256, 175/61, 73, 74
See application file for complete search history.

(56) References Cited

U.S. PATENT DOCUMENTS

| | | | | |
|---|---|---|---|---|
| 3,743,034 | A | | 7/1973 | Bradley |
| 3,825,051 | A | | 7/1974 | Sigmund |
| 4,077,657 | A | | 3/1978 | Trzeciak |
| 4,303,135 | A | | 12/1981 | Benoit |
| 4,394,881 | A | | 7/1983 | Shirley |
| 4,442,908 | A | | 4/1984 | Steenbock |
| 4,745,982 | A | | 5/1988 | Wenzel |
| 5,052,501 | A | | 10/1991 | Wenzel et al. |
| 5,090,497 | A | * | 2/1992 | Beimgraben et al. ..... 175/107 |
| 5,117,927 | A | | 6/1992 | Askew |
| 5,168,943 | A | | 12/1992 | Falgout, Sr. |
| 5,332,049 | A | * | 7/1994 | Tew ..... 175/320 |
| 5,343,966 | A | | 9/1994 | Wenzel et al. |
| 5,452,923 | A | | 9/1995 | Smith |
| 5,479,995 | A | | 1/1996 | Falgout, Sr. |
| 6,296,066 | B1 | | 10/2001 | Terry et al. |
| 6,598,687 | B2 | | 7/2003 | Eppink et al. |
| 6,607,044 | B1 | | 8/2003 | Eppink et al. |
| 6,843,332 | B2 | * | 1/2005 | Eppink et al. ..... 175/73 |
| 7,195,083 | B2 | | 3/2007 | Eppink et al. |
| 2004/0104051 | A1 | | 6/2004 | Moriarty et al. |
| 2006/0254825 | A1 | | 11/2006 | Krueger et al. |

OTHER PUBLICATIONS

PCT International Search Report and Written Opinion, Sep. 9, 2009, Lee W. Young (Authorized Officer), 8 pages, International Searching Authority/United States (ISA/US).

(Continued)

*Primary Examiner* — Jennifer H Gay
*Assistant Examiner* — Catherine Loikith
(74) *Attorney, Agent, or Firm* — Abimbola Bukoye; Michael Locklar; Jackson Walker LLP

(57) ABSTRACT

A housing including longitudinally extending tubular members interconnected to allow controlled relative bending thereof, during a drilling operation, a rotary drive transmitting torsion bar extending generally longitudinally within the housing to controllably bend in response to relative bending of said members, a rotary drill bit operatively connected to said torsion bar to be rotated as the bar rotates, a rotary drive operatively connected to the torsion bar to rotate the bar, means for controlling relative bending of the said members during torsion bar rotation and as a function of such rotation.

13 Claims, 5 Drawing Sheets

OTHER PUBLICATIONS

PCT Written Opinion, Aug. 31, 2010, David Bagnell (Authorized Officer), 4 pages, International Preliminary Examining Authority/United States (IPEA/US).

CHII Response to Second Written Opinion (ISA/237/IPEA/408), 23 pages, filed with Mail Stop PCT, U.S. Patent and Trademark Office on Oct. 26, 2010.

* cited by examiner

DOWNHOLE ADJUSTABLE BENT-ANGLE MECHANISM FOR USE WITH A MOTOR FOR DIRECTIONAL DRILLING

BACKGROUND OF THE INVENTION

This invention relates generally to directional drilling of boreholes in the earth, and more particularly concerns improvements in such drilling techniques and apparatus employing mud motors.

Early apparatus and methods employed a device known as a whipstock, that was lowered into a borehole and oriented to the direction of desired borehole divergence from its initial path. That apparatus had a tapered portion that would force the drill bit to diverge in the oriented direction. Later apparatus and methods were developed that used a down-hole motor, driven by drilling-mud flow or other means. Such motors may be mounted to the lower end of a bent subassembly, such that the longitudinal axis of the motor and the drilling bit at its lower end, are at a slight angle to the direction of the drill string above the bent subassembly. When it is desired to drill in a generally straight path, the motor is activated and the drill string is continuously rotated. When it is desired to cause the path of the borehole to diverge in a given direction, continuous rotation of the drill string is stopped. The drill string, bent subassembly, motor and bit are then rotated to position the direction of bend in the bent subassembly in the desired direction of divergence, the upper part of the drill string is held in this position, and the down-hole motor is started. This causes the subsequent borehole to diverge in the desired and selected direction. More commonly, in current practice, sufficient flexibility or allowable angular motion between the motor and the bit is relied upon to permit alternative placements of the bent subassembly between the motor and the bit.

With respect to each of these alternative placements of the bent subassembly, the radius of curvature of the borehole path away from its normally straight orientation and the related angular deviation per unit of along-hole drill progression depend directly on the bend angle of the bent subassembly. Further, when trying to drill a straight hole by rotating the drill string as well as the motor connected to the drill bit, a bent subassembly tends to cause the borehole diameter to be larger than it would be in normal drilling. In the early usage of such processes and equipment, it was necessary to pull the drill string and change the bent subassembly to one of a different bend angle to achieve a change in the angle change per unit of along-hole drill progression and the related radius of curvature. Also, if long straight sections of hole were to be drilled, it was often best to pull the drill string to remove the bent subassembly. Either or each of these procedures caused delay, and therefore increased cost in directional drilling operations.

One expedient was to provide a bent subassembly that would enable its bend angle to change, as desired as by commands from the surface that were transmitted downwardly in the borehole to cause the desired change in bend angle. The very high stresses and very high axial mechanical loads in the drill string have generally led to very complex and costly mechanisms to achieve the desired capability to change the bend angle by surface command. Examples of the prior art include U.S. Pat. Nos. 4,077,657, 4,303,135, 4,394,881, 4,442,908, 4,745,982, 5,052,501, 5,117,927, 5,168,943, 5,343,966 and 5,479,995. Most of these do not provide means to control the bend angle when the drilling assembly is downhole. A few that do provide such control provide only limited control, for example no bend or a fixed bend angle. None of such prior art satisfies the need for simplicity, degree of control and prospective low cost for acquisition, operation and maintenance.

Of some interest are recent prior art mechanisms characterized by a two-axis bent subassembly that can provide bend angles in two nominally orthogonal directions at a very rapid rate. These devices are generally not used with a downhole motor to drive the rotation of the drill bit. These mechanisms are generally used in certain steerable rotary drilling approaches that steer the borehole path while continually rotating the drill string and manipulating the bend angle synchronously with this drill string rotation, the resulting direction of deviation of the borehole being determined in effect by the relative phase or phases of the bend angle motions and the drill string rotation angle. In such mechanisms, the control bandwidth must be at least equal to the maximum drill string rotation rate of usage. Examples of the prior art of this type include some early U.S. Patents such as U.S. Pat. Nos. 3,743,034 and 3,825,051 and more recent examples such as U.S. Pat. Nos. 6,296,066, 6,598,687, 6,607,044, 6,843,332 and 7,195,083. These are not relevant to the single-angle bend mechanism of the present invention. They require much more complex mechanisms requiring high-speed angular motions at the drill string rotation rate in two orthogonal directions.

SUMMARY OF THE INVENTION

It is a major object of the present invention to provide a simpler and lower cost single-angle bend mechanism to provide bend motion in one direction only under command for direction control from the surface. One objective of this invention to provide such a simpler and lower cost bend mechanism that may be integrated in or with a Reduced-Length Measure While Drilling Apparatus Using Electric Field Short Range Data Transmission, as described in U.S. patent application Ser. No. 11/820,790 filed Jun. 21, 2007 and published as U.S. Patent Application Publication No. US2008/0034856 on Feb. 14, 2008.

Another major object is to provide improved directional drilling apparatus that comprises:

a) a housing including longitudinally extending tubular members interconnected to allow controlled relative bending thereof, during a drilling operation, b) a rotary drive transmitting torsion bar extending generally longitudinally within the housing to controllably bend in response to relative bending of such members, c) a rotary drill bit operatively connected to the torsion bar to be rotated as the bar rotates, d) a rotary drive operatively connected to the torsion bar to rotate the bar, e) means for controlling relative bending of the such members during torsion bar rotation, and as a function of such rotation.

Another object is to provide a flexure interconnecting the two housing members to accommodate relative bending thereof. Such flexure advantageously incorporates meshing fingers, as will be seen.

A further object includes provision of a hydraulic ram assembly located sidewardly of said torsion bar, the ram assembly typically carried by one of the tubular members. Such members advantageously having axes A and B that define an angle a therebetween, which cyclically increases and decreases during torsion bar rotation. The torsion bar has a drive transmitting end angularly controlled by one of the members.

Yet another object includes provision of a method of subsurface directional drilling, that includes:

a) providing a sub-surface rotary drilling bit carried by a drilling string, b) providing and operating a sub-surface drilling fluid driven motor for rotating the bit, c) providing and operating a fluid pressure responsive bit deflector assembly carried by the string proximate the bit location, to locally and controllably increase and decrease the angularity of bit deflection relative to the string. That method may include providing an upper tubular housing member associated with the motor, a lower tubular housing member associated with the bit, a flexure interconnecting those members to permit relative bending thereof, and a ram assembly to controllably deflect the lower member related to the upper member, at the flexure.

An additional object includes provision of a highly compact and reliable assembly wherein one of two housing members defines an axis, the flexure extends at one side of that axis, and means that includes an hydraulic ram assembly located at the opposite side of said axis and is carried by the one housing member, and a torsion bar extending within one of the housing members. As will be seen, the ram assembly typically includes an actuator operatively connected to the other of said two housing members, to effect controlled pivoting thereof at or proximate said flexure.

These and other objects and advantages of the invention, as well as the details of an illustrative embodiment, will be more fully understood from the following specification and drawings, in which:

DRAWING DESCRIPTION

FIGS. 1*a*, 1*b* and 1*c* illustrate a longitudinal cross-section of a preferred apparatus of the present invention, and wherein FIG. 1*b* is as extension of FIG. 1*a* and FIG. 1*c* is an extension of FIG. 1*b*;

DETAILED DESCRIPTION

Figure 1A:
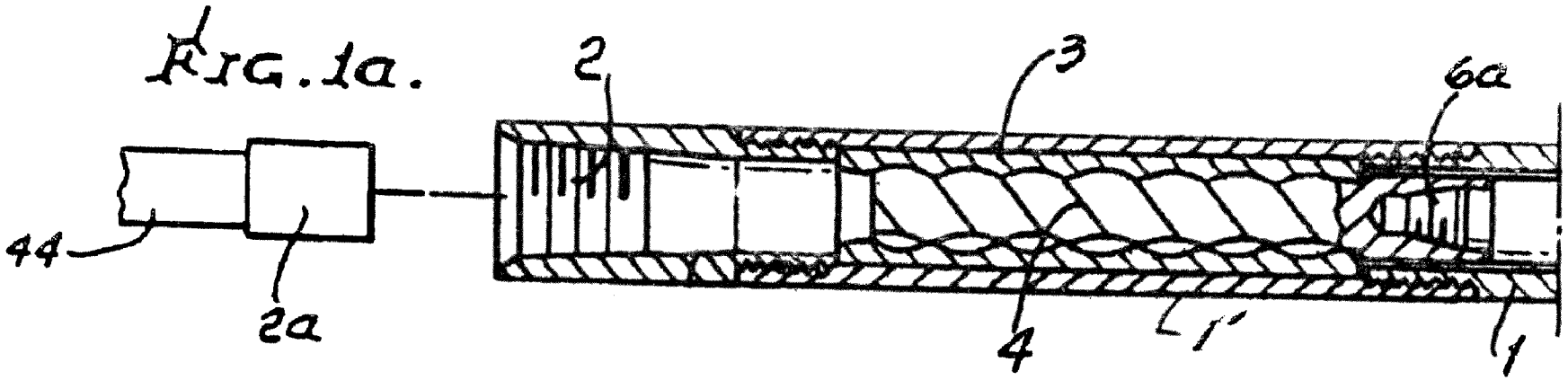
Figure 1B:
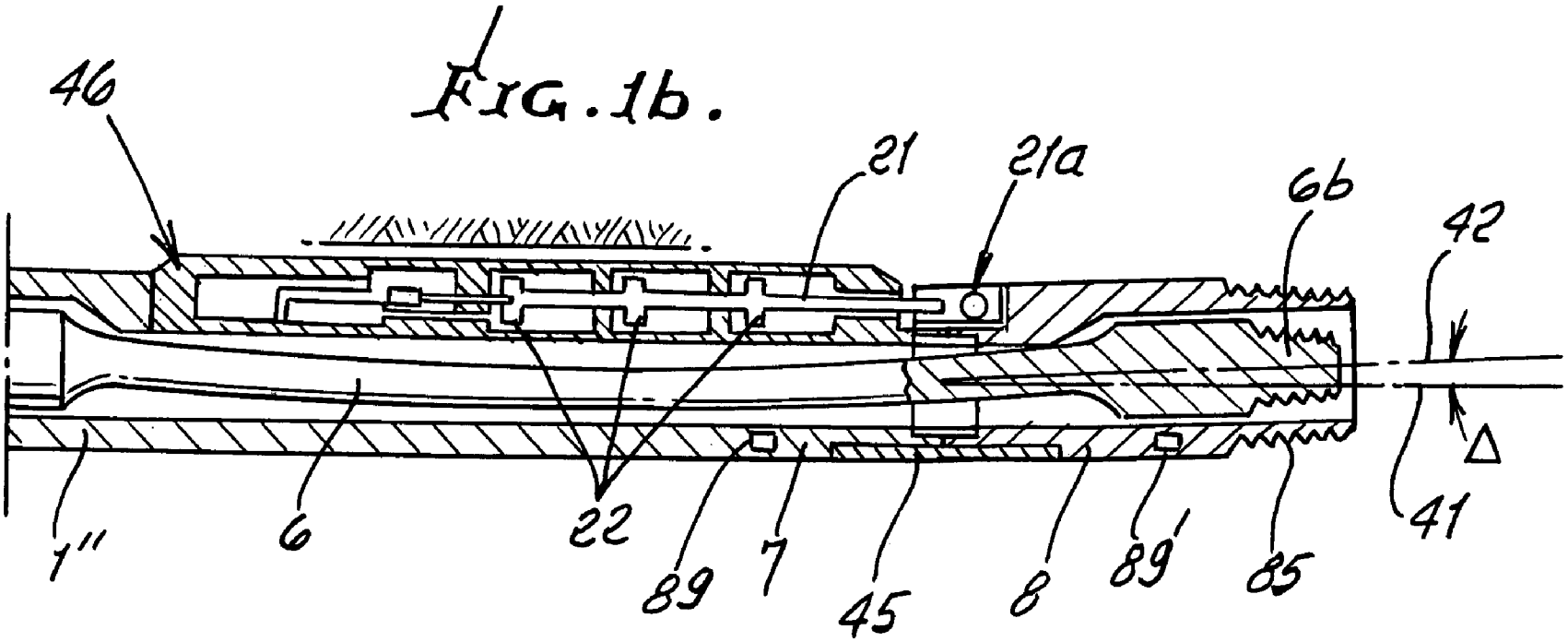
Figure 1C:
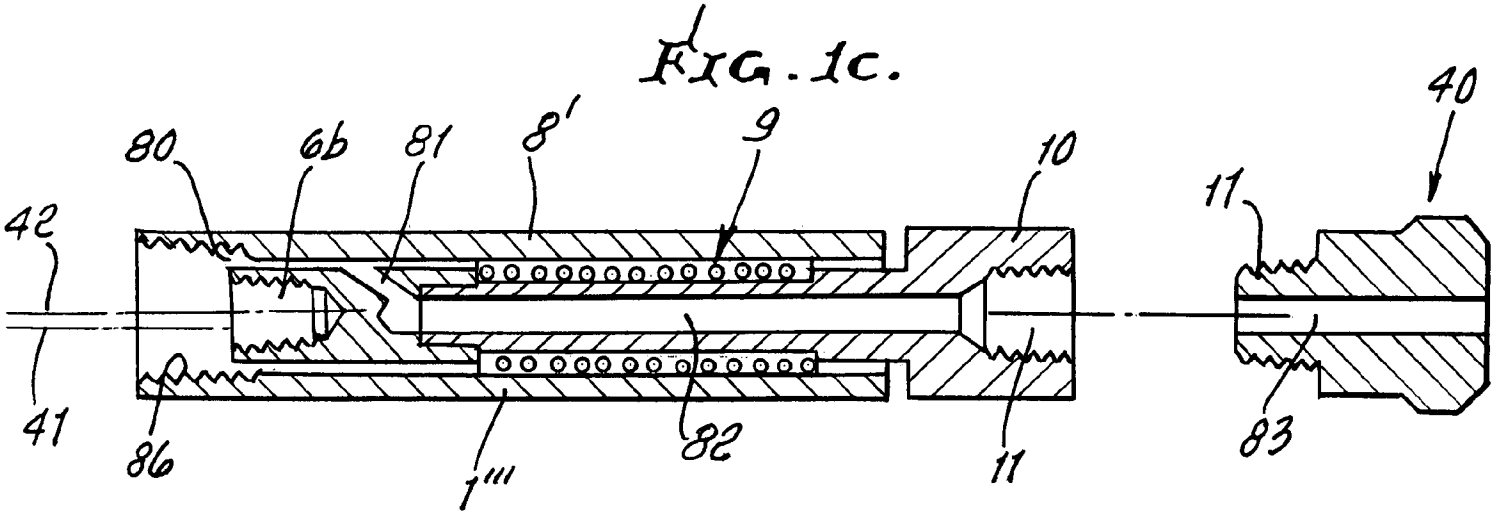

FIG. 1*a* thru FIG. 1*c* show a longitudinal cross section of the apparatus of the present invention, as the major components.

The outer case or main housing 1, which may include multiple sections 1', 1" and 1'" along its length, is shown to have a threaded tubular connection 2 at its upper end, for connection to other elements of a drill string 44 above this apparatus indicated generally at 2*a*. A stator 3 and a rotor 4 for a "Moineau" or progressive-cavity type motor operated by the flow of drilling fluids pumped down through the drill string from the surface, are shown. See also U.S. Pat. No. 1,8982,217 to Moineau. A torsion bar or flexible shaft 6 is used to connect the eccentric output motion of the motor rotor 4 to the lower elements of the apparatus. See shaft connection 6*a*. The lower end of the shaft 6 is connected as at 6*b* to a rotary tubular shaft 10 which drives a bit attached to the threaded connection 11 at the lower end of the apparatus.

The bit is diagrammatically indicated at 40 and receives drilling fluid via passages 80, 81, 82 and 83 . A bent tubular subassembly including upper and lower housings or sections 7 and 8 houses a radial and thrust bearing assembly 9 that transfers load from the bit at the lower end of the assembly, and shaft 10 , to the case 8'. Bending of the torsion shaft 6 as shown accommodates both the eccentric motion of the motor rotor 4 and the bend angle between the axis 41 of the housing 1 , and the bent axis 42 of the bent sections 7 , 8 and case 8'. Case 8' is connected to section 8 via a pin 85 and box 86 connection. As shown, axis 42 is concave toward axis 41 , and convex radially away from axis 42 . For suitable drilling operations, the bend angle A, (delta), between the housing axis 41 and the bent subassembly axis 42 typically lies in the range of 0to 3degrees.

One major objective is to combine these features in a downhole adjustable direction defining mechanism that can be drilling directional control initiated at the surface to command the drilling motor by means of short range transmission while drilling is in process, permitting full control of the motor to drill straight ahead, or by articulation, cause the drive of the motor rotary output to initiate a precision rate of turn achieving a planned drilling direction programmed into the control computer, without requiring extraction of the tool from the hole for external adjustment. During the directional drilling, drilling control parameters from near bit sensors indicated schematically at 89 and 89' may typically be transmitted real time to the surface by a short range data transmission, if provided, allowing for fine and precise incremental control adjustments in the bend angle of the mechanism, resulting in changes in the drill path as deemed necessary. Features of the adjustable bend angle subassembly are shown in FIG. 1*b*. The upper housing 7 is connected to the lower housing 8 by a flexure or hinge member 45 at one side by axis 41. A hydraulic ram assembly 46 is shown at the opposite side of axis 41, as having three pistons 22 in mechanical force series and in hydraulic input pressure parallel to drive actuator 22' linearly. See also FIG. 2. This mechanism provides a mechanical force to bend the flexure or hinge member 45, and also the shaft 6. The number of such series pistons and their diameter can be selected to obtain the desired force within an allowable diameter. In effect, the force of the shown three pistons is three times the force that a single piston of the same diameter would provide.

As shown, one of the two housings 7 and 8 defines an axis, as for example at 41, and the other member defines axis 42 as during bending; the flexure 45 extends at one side of that axis, and force exerting means includes the hydraulic ram assembly 46 located at the opposite side of that axis, and is carried by said one housing member 7. The torsion bar extends within said one housing member. Also, the ram assembly includes a linear actuator 21 operatively connected 21*a* to the other of the two sections 7 and 8 (for example section 8), to effect controlled relative pivoting of section 8 relative to section 7, at or proximate the flexure. A highly compact, reliable assembly of elements is thereby provided.

Figure 2:
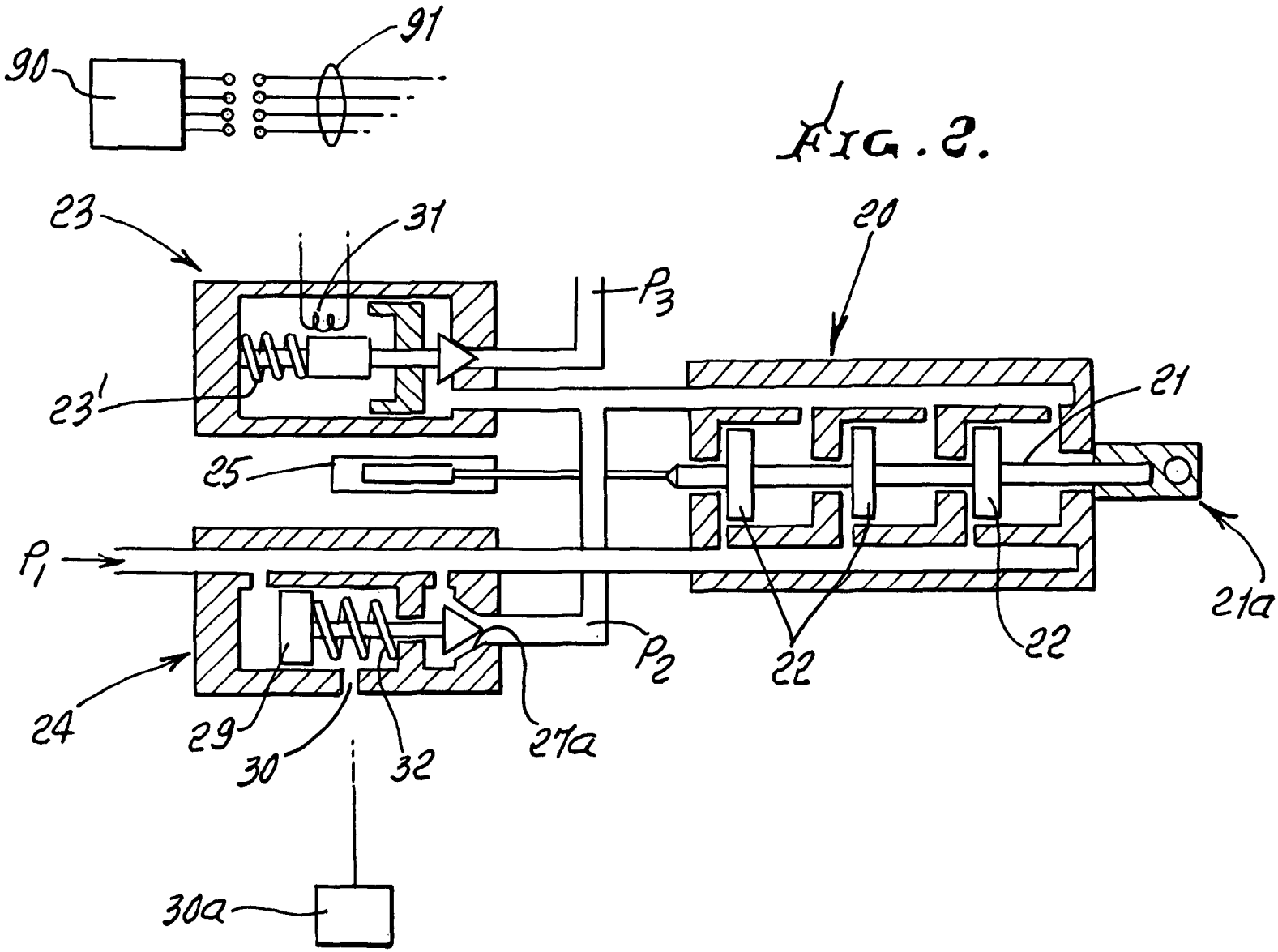
FIG. 2 shows details of the hydraulic mechanisms also shown in FIG. 1*b*, and the control valves for the hydraulic fluid to operate pistons.

The control system for the hydraulic ram 46 is shown in FIG. 2, and includes a piston assembly 20 driving an output linear actuator or rod 21, three pistons 22, a solenoid electrically controlled valve 23, a fill valve 24 and a piston position transducer 25. The control input pressure port is labeled P1. The fill valve 24 is a normally open valve, that remains open until high (Standpipe) pressure (P1) provided by mud pumps at the surface is applied. It remains open until the high pressure fluid primes or fills the lines and both cavities of the hydraulic ram piston assembly 20. When there is no more fluid flow, the pressure on the fill valve piston 29 overcomes the force of spring 32 holding the valve open. Oil is slowly pumped out of the spring cavity around a controlled fitting shaft (orifice) into an expanding bladder shown diagrammatically at 30*a* connected to port 30. As long as there is standpipe pressure applied, the differential piston configuration keeps the spring 32 compressed, forming a shut-off valve at the seat 27*a*. The oil is used as an "hydraulic fuse" and the expansion bladder also acts as a temperature expansion compensator. When the Fill Valve shuts off, with P1 in all lines, the closed loop pressure is now designated as P2.

When the solenoid valve 23 is activated (opened) using solenoid coil 31, it dumps the pressure P2 into the bypass line P3, forcing the ram pistons to move to the right. This motion of the pistons is sensed by the position transducer 25. When the desired linear motion distance of 21 (corresponding to controlled bending of 8 relative to 7) has been achieved, the solenoid valve 23 is closed and the piston position remains fixed, having achieved the desired bend angle of the housings 7 and 8 at the flexure or hinge member 45.

The Fill Valve also acts as a failsafe safety device. When pumps are shut down (i.e. no standpipe pressure), the spring 23' opens the valve 23, returning the hydraulic ram to neutral. This happens even if there is an electrical, signal or battery failure. Thus, there is no problem in trying or having to withdraw a bent angle mechanism from the borehole in a bent condition. The FIG. 2 control assembly is typically located in association with the ram assembly.

Figure 3:
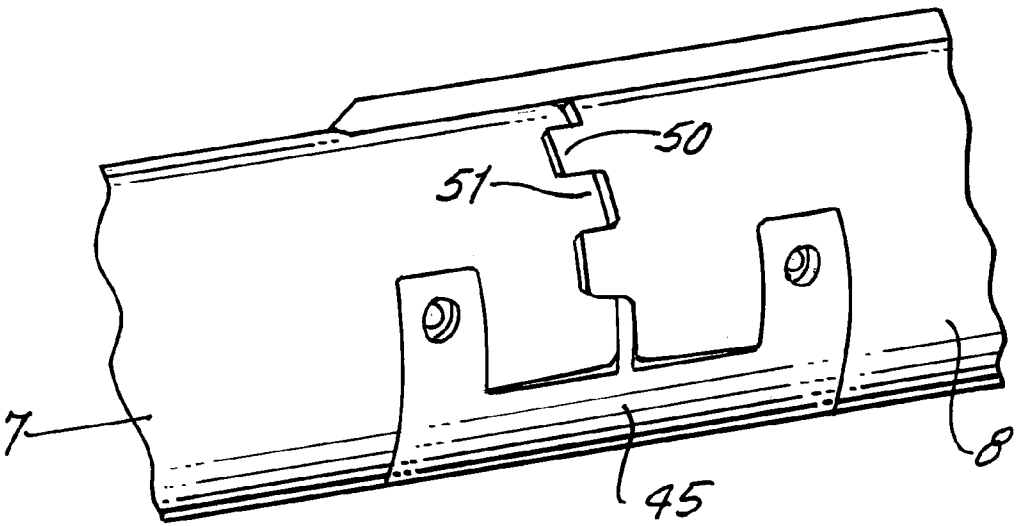
FIG. 3 shows an external portion of the apparatus of the invention, with interlocking fingers between tubular members to provide alignment and torque transfer between same.

Although the flexure or hinge member 45 accommodates the bend angle of the assembly, mechanisms are required to support both the axial and torsional forces between the upper housing 8 an the lower housing 7 in FIG. 1 *b*. FIG. 3 shows the upper housing 8 , the lower housing 7 , flexure or hinge member 45 and interlocking sliding fingers or pins 50 and 51 to provide axial and torsional load capability and guiding of bending.

Figure 4A:
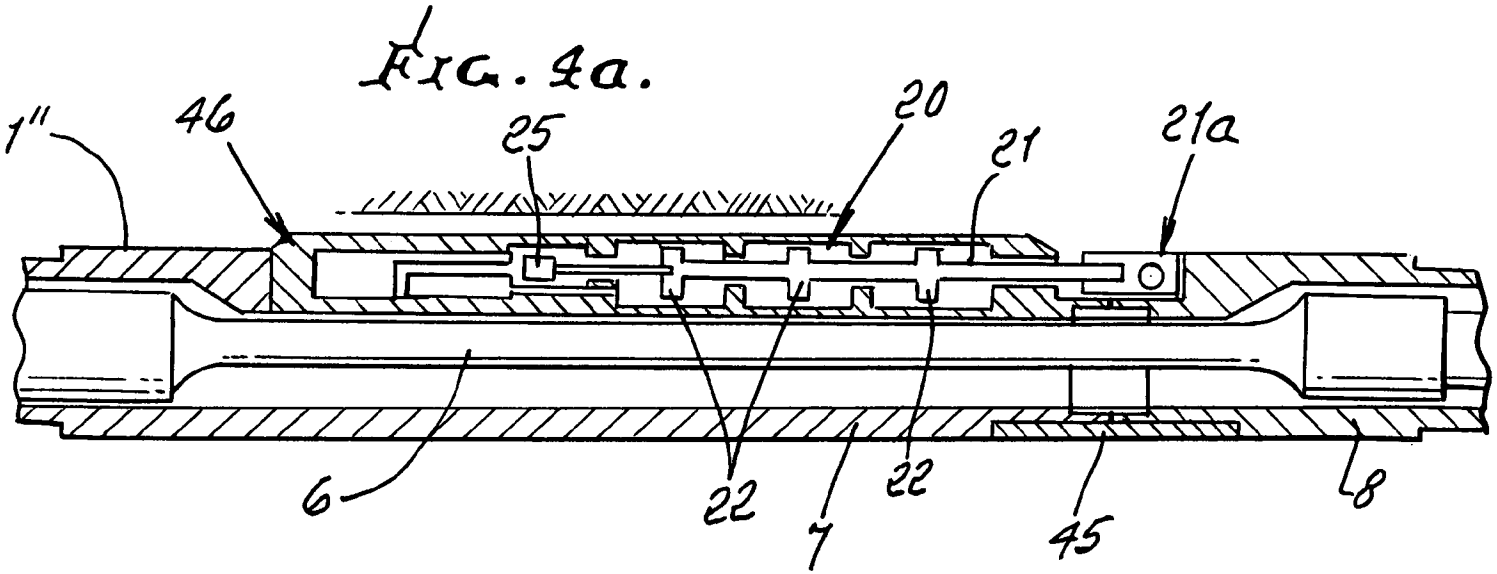
FIG. 4*a* and FIG. 4*b* show the relative positions of elements from FIG. 1*b* for two different bend angles of the assembly.
Figure 4B:
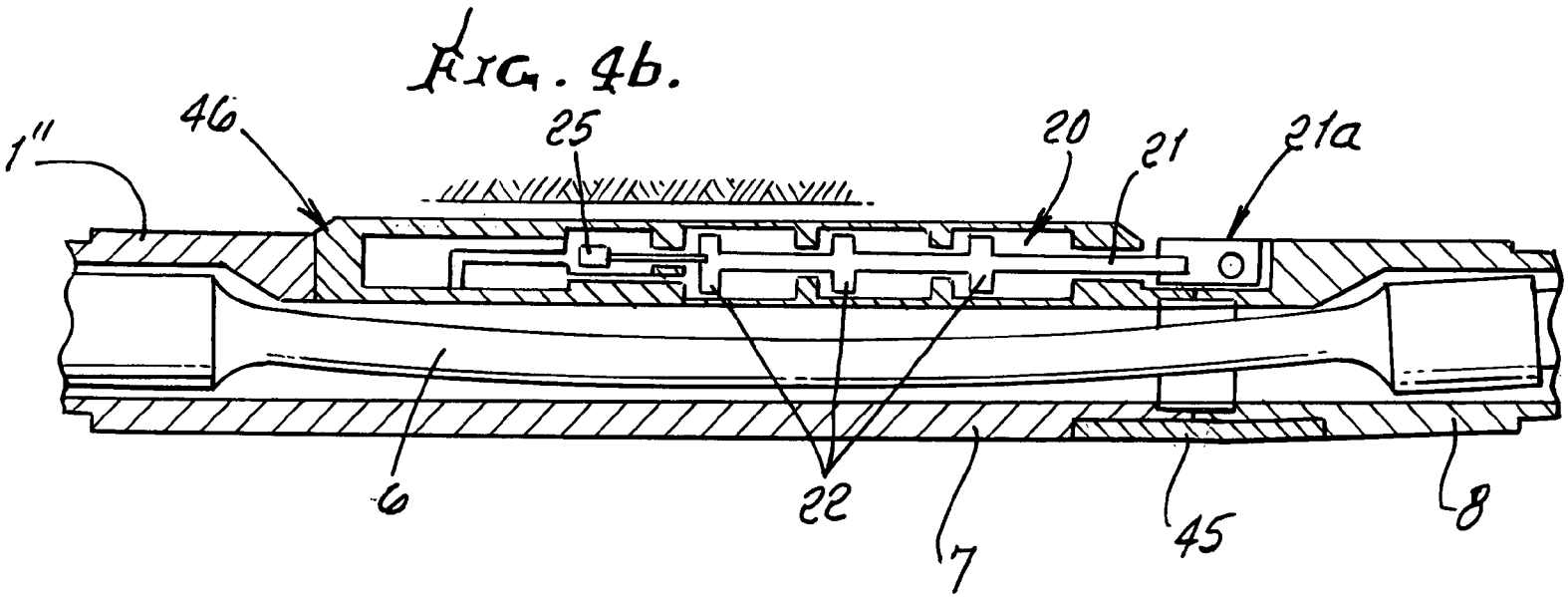

FIG. 4*a* and FIG. 4*b* show the relationship of the parts of FIG. 1*b* for both a straight, non-bent condition and a bent condition.

A surface control electronics assembly is employed to accomplish the controlled functions needed for the bend angle mechanism. See box 90 in FIG. 2. The required functions for this assembly are to receive a desired bend angle command from the surface or other equipment and to control the solenoid valve that controls the bend angle. Further, various sensors may be added near the drill bit at the bottom of the bent-angle mechanism to sense and transmit data to the surface. The transmission of bend angle commands from the surface to the downhole mechanism may be performed as by a series of links, some from the surface to intermediate locations and then others for a final link. See representative links 91. One example for a final link in such a chain is shown in another application for a Reduced-Length Measure While Drilling Apparatus Using Electric Field Short Range Date Transmission as described in U.S. patent application Ser. No. 11/820,790 filed Jun. 21, 2007 and published as U.S. Patent Application Publication No. US2008/0034856 on FIG. 14, 2008. Electrical details of the short hop communication method are provided in U.S. patent application Ser. No. 11/353,364, Electric Field Communication for Short Range Date Transmission in a Borehole. Similarly, the published U.S. Patent Application, Publication No. US2008/0034856, describes the use of a number of sensor types that may be provided in a sensor and data transmission element for the present invention. These applications and publications are incorporated herein, by reference.

Accordingly, the invention provides preferred highly effect method of sub-surface directional drilling that includes:

a) providing a sub-surface rotary drilling bit carried by a drilling string, b) providing and operating a sub-surface drilling fluid driven motor for rotating the bit, c) providing and operating a fluid pressure responsive bit deflector assembly carried by the string proximate the bit location, to locally and controllably increase and decrease the angularity of bit deflection relative to the string.

More specifically the method employs a) a rotary drilling bit carried by a drill string, b) a sub-surface drilling fluid driven motor having an eccentric output, c) a torsion shaft rotated by the rotor to rotate the bit, d) a tubular housing for the motor and shaft, the housing having sections, and there being a flexure inter-connecting two of the sections, e) and a ram assembly for angularly deflecting a lower one of the sections relative to an upper section, to angularly deflect the bit, the steps that include, and the steps of the method include f) operating the ram assembly in one mode to angularly deflect the lower housing and the bit to one position for rotary drilling a relatively wider hole, and g) operating the assembly in another mode to enable operation of the bit at a relatively reduced angular deflection for rotary drilling of a less wider hole.

We claim:

1. A method for downhole directional drilling comprising:

providing a housing that comprises a plurality of longitudinally interconnected sections wherein the plurality of longitudinally interconnected sections comprise a first section and a second section and wherein the first section is adjacent to the second section;

providing a rotary drive wherein the rotary drive is situated in the housing, wherein the rotary drive comprises a stator and a rotor wherein the stator is affixed to the housing wherein the rotor is situated in the stator;

providing a torsion bar operatively connected to the rotary drive and wherein the torsion bar is situated within the housing;

providing a flexure outside of the housing that interconnects the first section to the second section wherein the flexure permits bending of the two longitudinally interconnected sections relative to one another and the flexure comprises meshing fingers;

providing a ram shaft operatively affixed to first section such that the ram shaft provides a mechanical force upon the second section so as to provide relative bending of the first and second sections;

providing an output shaft operatively connected to the torsion bar;

providing a drill bit operatively connected to the output shaft;

actuating the ram shaft so as to provide a mechanical force upon the second section so as to provide a relative bending of the first and second sections; and actuating the rotary drive so as to provide rotation of the drill bit.

2. The method of claim 1 further comprising providing a piston operatively connected to the ram shaft; and actuating the piston with hydraulic fluid.

3. The method of claim 2 further comprising providing a solenoid operatively connected to a valve wherein the valve when actuated allows hydraulic fluid to actuate the piston so as to actuate the ram shaft.

4. The method of claim 3 further comprising providing a surface control assembly communicatively linked to the solenoid wherein the surface control assembly is adapted to receive an actuation command from the surface and actuate the solenoid upon receiving said actuation command; and sending the actuation command to the surface control assembly.

5. The method of claim 3 further comprising locating the flexure on the housing substantially opposite of the ram shaft.

6. A downhole directional drilling apparatus comprising:

a housing that comprises a plurality of longitudinally interconnected sections wherein the plurality of longitudinally interconnected sections comprises a first section and a second section wherein the first section is adjacent to the second section;

a rotary drive wherein the rotary drive is situated in the housing, wherein the rotary drive comprises a stator and a rotor wherein the stator is affixed to the housing wherein the rotor is situated in the stator;

a torsion bar operatively connected to the rotary drive and wherein the torsion bar is situated within the housing;

a flexure that interconnects the first section to the second section and wherein the flexure permits bending of the first and second sections relative to one another and the flexure comprises meshing fingers;

a hydraulic ram affixed to the first section and wherein the hydraulic ram is adapted to provide relative bending of the first and second sections;

an output shaft operatively connected to the torsion bar; and a drill bit operatively connected to the output shaft so as to provide rotation of the drill bit upon actuation of the rotary drive.

7. The downhole directional drilling apparatus of claim 6 wherein the hydraulic ram is affixed to the first section and wherein the hydraulic ram comprises a ram shaft that is adapted to provide a mechanical force between the first and second sections so as to provide a bending of the second section relative to the first section.

8. The downhole directional drilling apparatus of claim 7 wherein the flexure is located on the housing substantially opposite of the hydraulic ram.

9. The downhole directional drilling apparatus of claim 7 wherein the hydraulic ram further comprises a piston wherein the piston is adapted to provide an axial force to the ram shaft.

10. The downhole directional drilling apparatus of claim 9 further comprising a solenoid that is adapted to actuate a valve for allowing hydraulic fluid to actuate the piston.

11. The downhole directional drilling apparatus of claim 10 wherein the solenoid is adapted to receive actuation commands from a surface control assembly that is adapted to receive actuation commands from the surface.

12. The downhole directional drilling apparatus of claim 6 wherein the flexure comprises a hinge member.

13. A downhole directional drilling apparatus comprising:

a housing that comprises a plurality of longitudinally interconnected sections;

a rotary drive wherein the rotary drive is situated in the housing, wherein the rotary drive comprises a stator and a rotor wherein the stator is affixed to the housing wherein the rotor is situated in the stator;

a torsion bar operatively connected to the rotary drive and wherein the torsion bar is situated within the housing;

an output shaft operatively connected to the torsion bar wherein the output shaft is operatively connected to a drill bit;

the drill bit operatively connected to the torsion bar through the output shaft to provide rotation of the drill bit upon actuation of the rotary drive; and a means for providing a relative bending of the two longitudinally interconnected sections, wherein the means for providing the relative bending comprises a flexure comprising meshing fingers and wherein the flexure interconnects the first section to the second section and wherein the flexure permits bending of the first and second sections relative to one another.

* * * * *